US006905056B2

(12) United States Patent
Dittrich

(10) Patent No.: US 6,905,056 B2
(45) Date of Patent: Jun. 14, 2005

(54) SETTING TOOL

(75) Inventor: Tilo Dittrich, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/738,327

(22) Filed: Dec. 17, 2003

(65) Prior Publication Data

US 2004/0182907 A1 Sep. 23, 2004

(30) Foreign Application Priority Data

Dec. 19, 2002 (DE) ..... 102 59 567

(51) Int. Cl.[7] ..... B25C 1/14
(52) U.S. Cl. ..... 227/10; 173/212
(58) Field of Search ..... 227/10, 4, 7, 9; 173/210, 212

(56) References Cited

U.S. PATENT DOCUMENTS 3,792,645 A * 2/1974 Chirco et al. ..... 91/518
4,405,072 A * 9/1983 Kindle et al. ..... 227/10
4,658,913 A * 4/1987 Yantsen et al. ..... 173/208
5,653,370 A * 8/1997 Bereiter et al. ..... 227/10
6,123,242 A * 9/2000 Kersten ..... 227/10
2003/0218042 A1 * 11/2003 Odini et al.

* cited by examiner

*Primary Examiner*—Scott A. Smith
*Assistant Examiner*—Brian Nash
(74) *Attorney, Agent, or Firm*—Sidley Austin Brown & Wood, LLP

(57) ABSTRACT

A setting tool for driving fastening elements in a constructional component includes a drive piston displaceable in the guide space (11) of the piston guide (12) by propellant gases generated by a propellant charge from an initial position (40) thereof in the rear region (11.2) of the guide space (11) to an end position (41) in the front region (11.1) of the guide space, and a storage space (20) for the propellant gases and connected by a first valve (23) with the rear region (11.2) of the guide space (11) and connected by a second, electronically controlled valve (24) arranged at an outlet (21) of the storage space (20), with a time-delay, with the front region (11.1) of the guide space (11).

8 Claims, 6 Drawing Sheets

SETTING TOOL

BACKGROUND OF THE INVENTION

1. Field of the Invention

The present invention relates to a setting tool for driving fastening elements in a constructional component and including a piston guide defining a guide space having a front region and a rear region, a drive piston displaceable in the guide space by propellant gases generated by a propellant charge from its initial position in the rear region of the guide space to its end position in the front region of the guide space, and a storage space for the propellant gases and connected by a valve with the rear region of the guide space, and having an outlet communicating with the front region of the guide space.

2. Description of the Prior Art

Setting tools of a type described above can be operated with evaporated, liquid or solid fuels. In the combustion-engined and explosion-operated setting tools, the drive piston in driven during a setting process by combusted gases. The drive piston drives the fastening elements in a constructional component.

The drive piston of the setting tool should be returned in its initial position after a drive-in process in order to be able to execute a next attachment process.

German Publication DE-19547859A1 discloses a powder charge-operated setting tool in which the gases generated as a result of combustion of a propellant charge are used for returning the drive piston in its initial position.

In the setting tool of DE-19547859A1, the drive piston is displaceably supported in a guide space of a piston guide. Adjacent to the piston guide, there is provided a storage space that is connected with the guide space by an inlet channel provided with a check valve. An outlet opening connects the storage space with a setting direction end region of the guide space. During a setting process, hot, pressurized propellant or combustion gases partially flow into the storage space. After the storage space is filled, the check valve closes the inlet channel, and the stored gas flows through the outlet opening, with the piston being returned to its initial position by the internal end pressure applied by the gases.

In order to achieve a high functional reliability, a high storage pressure for a predetermined time period should be maintained. Practically, this is difficult to achieve for all operational conditions, different propellants, and different power outputs.

In conventional setting tools, because of leakage, a pressure loss occurs. The leakage occurs, among others, because of seal leakage in the bolt guide, in the gas flow, at piston head and piston stem. Also, cooling of the propellant gases in the storage space leads to loss of pressure. The cooling of the propellant gases results from a relatively large surface of the storage space which is coaxial with the piston. Also, a further drawback of this solution consists in that the propellant gas, which flows into a space in front of the piston, is compressed as a result of multiple rebounds of the drive piston which often occur, e.g., during driving of fastening element in constructional components containing steel. The compression of the propellant gas increases leakage at the bolt guide and the piston head. This results in inadequate end pressure, which leads to an incomplete displacement of the drive piston to its initial position.

Accordingly, an object of the present invention is to provide a setting tool of the type described above in which a reliable displacement of the drive piston in its initial position is insured.

SUMMARY OF THE INVENTION

This and other objects of the present invention, which will become apparent hereinafter, are achieved by arranging an electronically controlled valve at the outlet of the storage space for a time-delayed connection of the storage space with the front region of the guide space. The electronically controlled valve provides for flow of the compressed propellant gas, which is stored in the storage space, into the setting direction end region of the guide space in front of the drive piston for displacing it to its initial position. With an electronically controlled valve, it is possible only then initiate flow of the propellant gas, which is stored in the combustion chamber, when rebounds ceased and the drive piston remains stationary. The present invention prevents or at least substantially reduces leakage, and insures a reliable displacement of the drive piston to its initial position.

According to an advantageous embodiment of the present invention, the electronically controlled valve is displaced to its open position by an electronic signal that is time-delayed with respect to an actuation signal for initiating a setting process. The time delay can amount, e.g., to 10 msec. However, other time-delayed periods can be used as the time-delay depends, among others, on the size of the tool, the piston stroke, the piston mass, etc. . .

According to a further advantageous embodiment of the present invention, the-electronically controlled value is actuated by an electronic time switch that is located downstream of the actuation switch of the tool. When the actuation switch initiate a setting process or the ignition of the propellant, the time switch would sent, after a predetermined time-delay period, a command signal to the electronically controlled value. Ideally, the time-delay period of the time switch is so selected that the electronically control value opens only after the drive piston ceased to rebound and became stationary.

Advantageously, the storage space is additionally filled through the channel for power control according to venting principle. This measure reduces to a minimum increase of pressure in the storage space during the adjustment of the power output.

According to a still further advantageous embodiment of the present invention, the inventive setting tool is provided with a control unit for generating a time-delayed electronic switching signal. The control unit cooperates with sensor means arranged in the piston guide for determining at drive piston position and/or drive piston speed.

As soon as the sensor means determines that the piston became stationary at its end position at the front end of the guide space, the sensor means communicates an appropriate signal to the control unit. In response, the control unit communicates an opening signal to the electronically controlled valve.

An opening signal can also be communicated to the electronically controlled valve directly from the sensor means. In this case, a reliable displacement of the drive piston into its initial position after completion of a setting process is also insured.

Advantageously, the exhaust or the exhaust channel and storage space are so arranged that the heat, which is produced as a result of cooling of the exhaust gas, is used for heating of the storage space. This significantly reduces a pressure loss resulting from cooling of the propellant gas in the storage space.

The novel features of the present invention, which are considered as characteristic for the invention, are set forth in the appended claims. The invention itself, however, both as to its construction and its mode of operations together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
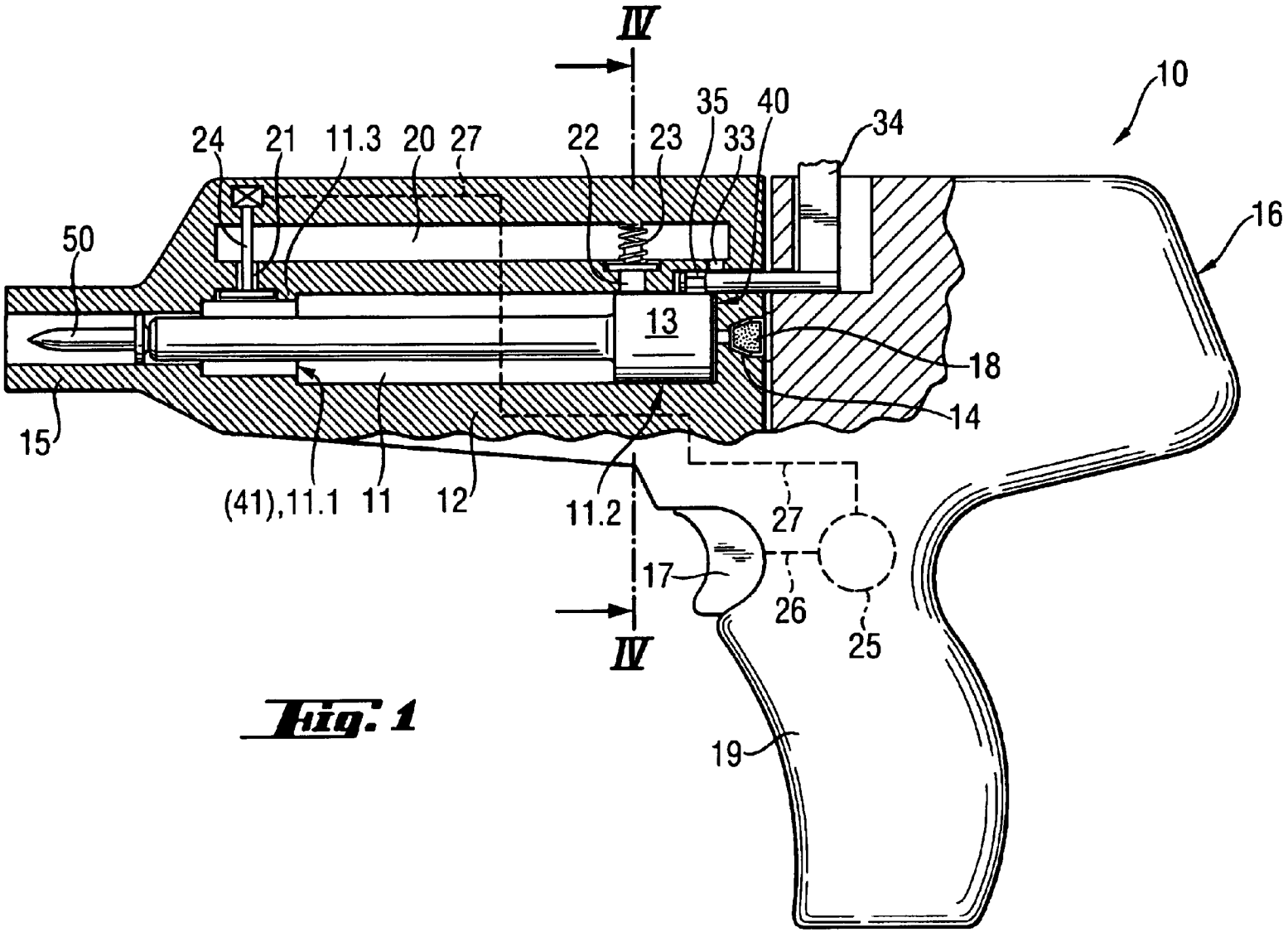
FIG. 1 a side, partially cross-sectional view of a setting tool according to the present invention with the drive piston in its rear initial position.

A setting tool 10 according to the present invention, a first embodiment of which is shown in FIGS. 1–6, includes a one-part or multi-part housing 16 in which a percussion mechanism is located. The percussion mechanism drives a fastening element such as, e.g., a nail, a bolt, etc. in a constructional component (not shown) when the setting tool 10 is pressed with its bolt guide 15 against the constructional component and is actuated.

The percussion mechanism includes, among others, a piston guide 12 that forms a guide space 11 in which a drive piston 13 is supported for an axial displacement, and the bolt guide 15. In the bold guide 15, a fastening element 50 is displaceable by a setting direction end of the drive piston 13 or by its piston rod to be driven in the constructional component. In the setting direction, the bolt guide 15 adjoins the piston guide 12. The setting tool 10, which is shown in FIGS. 1–6, can be-operated with a solid propellant 18 that forms a propellant charge and can be used in a form of cartridge, pelets, and the like. The propellant changes can be arranged in magazine strips, a magazine box, and the like and be advanced before the start of a setting process in a propellant charge chamber 14 and be stored there until ignition is initiated. The setting tool can also be so formed that it can be driven by a gaseous or liquid fuel. The setting process is initiated by a tool user, after the setting tool has been pressed against a constructional component, by depressing an actuation switch 17 provided on a handle 19 of the setting tool 10. The actuation switch 17 actuates, mechanically or electronically, an ignition device (not shown) that ignites the propellant charge 18.

In the setting tool 10, parallel to the guide space 11, a storage space 20 for propellant gas extends. Between the storage space 20 and the rear region 11.2 of the guide space 11, in which the piston 13 is located in its initial position, there is provided a through-channel 22 forming an inlet channel. The through-or inlet channel 29 is provided with a mechanical valve 23 which is spring-biased to its closed position and is formed as a check value. Between the storage space 20 and a front, in the setting direction, region 11.1 of the guide space 11, an outlet channel 21 is provided. The outlet channel 21 is provided with a normally-closed, electronically controlled valve 24, e.g., a solenoid valve or a piezo-electrical valve. The electronically controlled valve 24 is connected by a single-or multi-phase conductor 27 with an electrical time switch 25 that is controlled by the actuation switch 17 via an electrical conductor 26.

Figure 4:
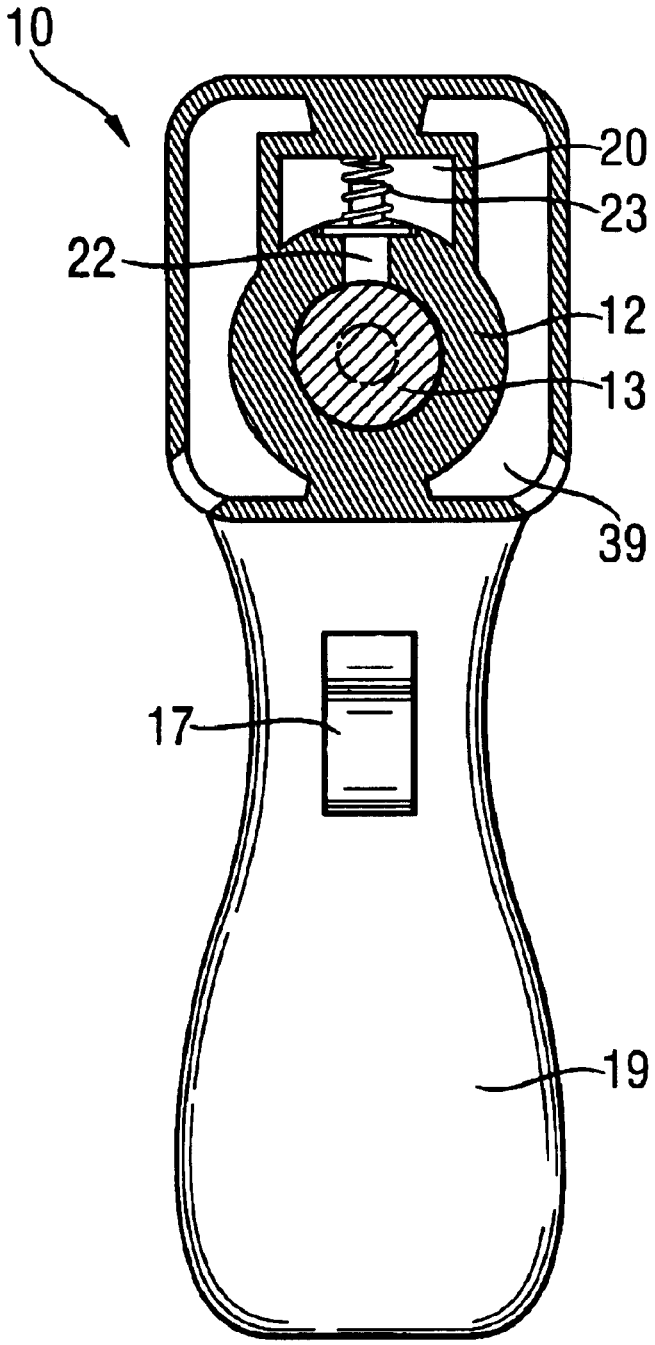
FIG. 4 a cross-sectional view along line IV—IV in FIG. 1.

FIG. 4 shows an exhaust channel 39 that branches from the guide space 11 and surrounds the storage space 20 that, thus, is heated by the propellant gas passing through the exhaust channel 39. This prevents a pressure loss which otherwise could have been caused by cooling of the propellant gas store in the storage space 20.

Figure 5:
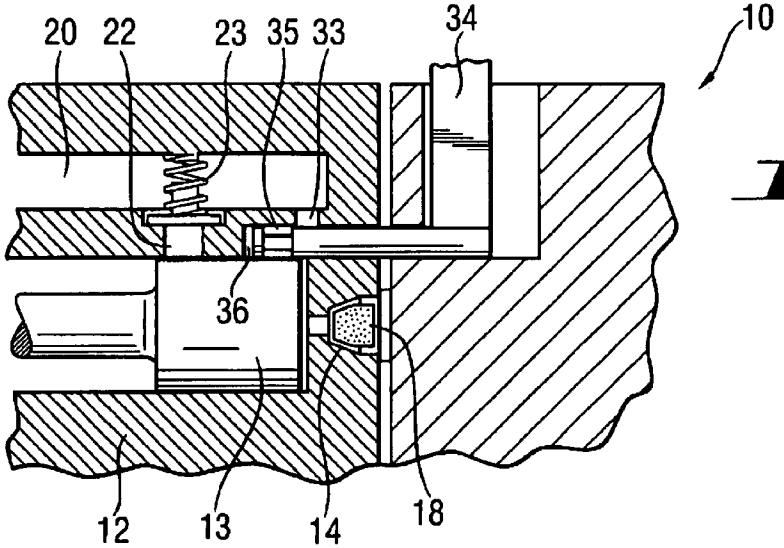
FIG. 5 a detail view of a section of the setting tool shown in FIG. 1, at an increased, in comparison with FIG. 1, scale, with an arrangement for controlling the power output in a first position.
Figure 6:
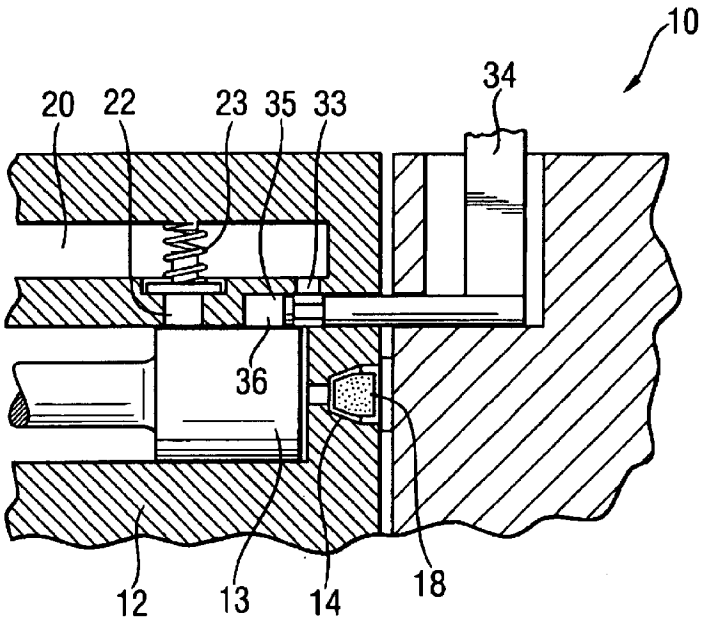
FIG. 6 a detail view similar to that of FIG. 5 but with the arrangement for controlling the power output in a second position.

As further shown in FIGS. 5–6, the setting tool 10 also includes a channel 36 which controls power. A manually operable adjusting member 34 is located in the channel 36. The adjusting member 34 controls the power of the setting tool by changing the cross-section of the channel 36. To this end, at the setting tool side end region of the adjusting member 34, there is provided an annular groove 35 or a tapering region and which cooperates with passage 33 connecting the channel 36 with the storage space 20. In FIG. 5, the tool power is high because the adjusting member 34 blocks and substantially closes the passage 33. The cross-section of the channel 35 is minimal. In FIG. 6, the tool power is insignificant as the annular groove 35 of the adjusting member 34 is located, in front of the passage 33, and the cross-section of the channel 36 is at its maximum. The propellant gases are fed in the storage space 20 immediately before the start of the setting displacement of the drive piston 13.

Figure 2:
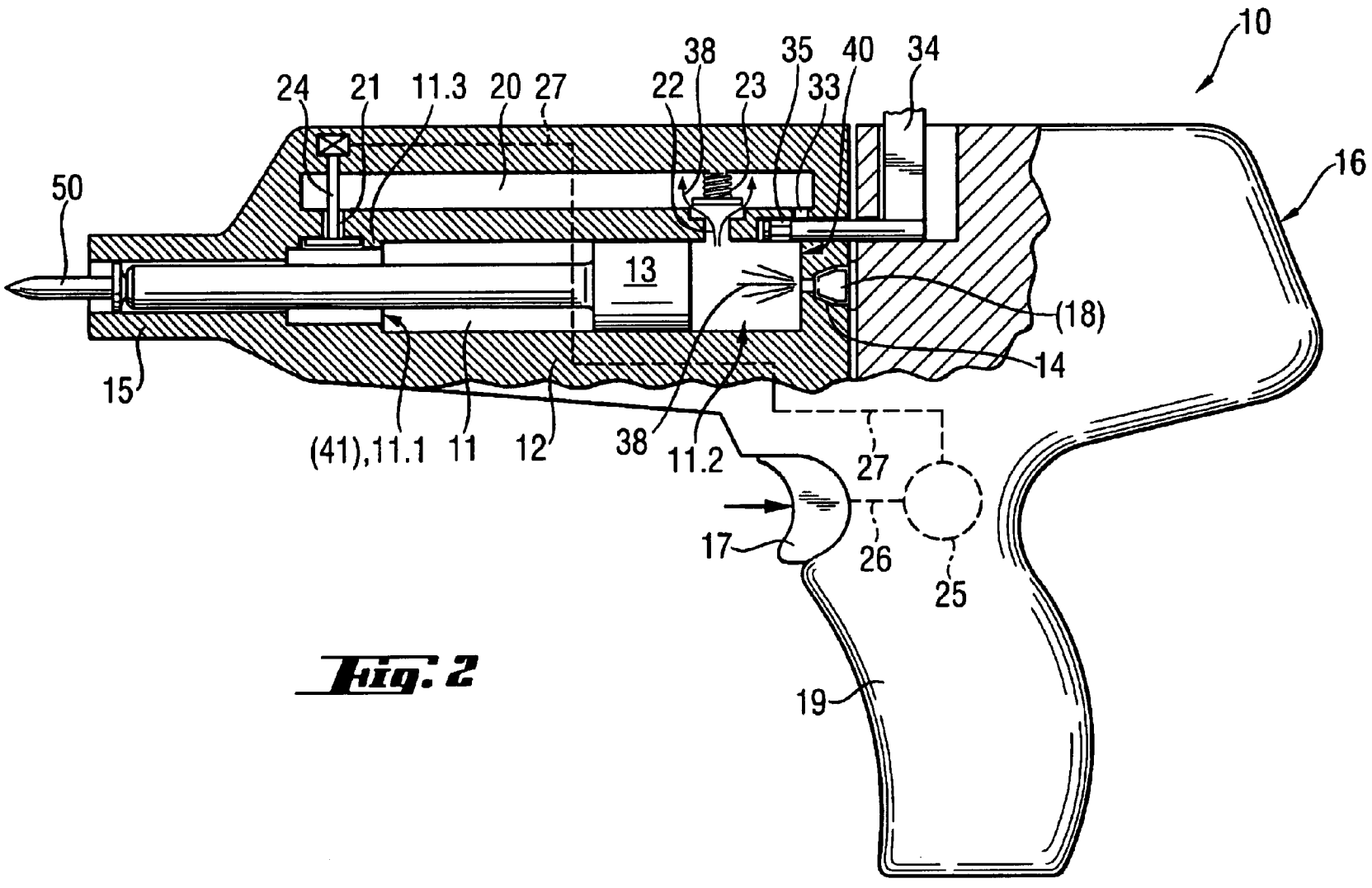
FIG. 2 a view similar to that of FIG. 1 after start of a setting process.

In FIG. 1, the setting tool 10 is shown with the drive piston 14 occupying its initial position in the rear region 11.2 of the guide space 11. Upon actuation of a setting process, the initial stage of which is shown in FIG. 2, the drive piston 13 is driven forward by propellant gases 18' generated as a result of ignition of the propellant charge 18. The pressure of the expanding propellant gases opens the valve 23, and the propellant gases 18' flow in the storage space 20. Simultaneously with the actuation of the setting process, an electrical signal is transmitted from the actuation switch 17 through the conductor 26 to the time switch 25. There, the signal is delayed, e.g., by 10 ms or by another suitable time period.

Figure 3:
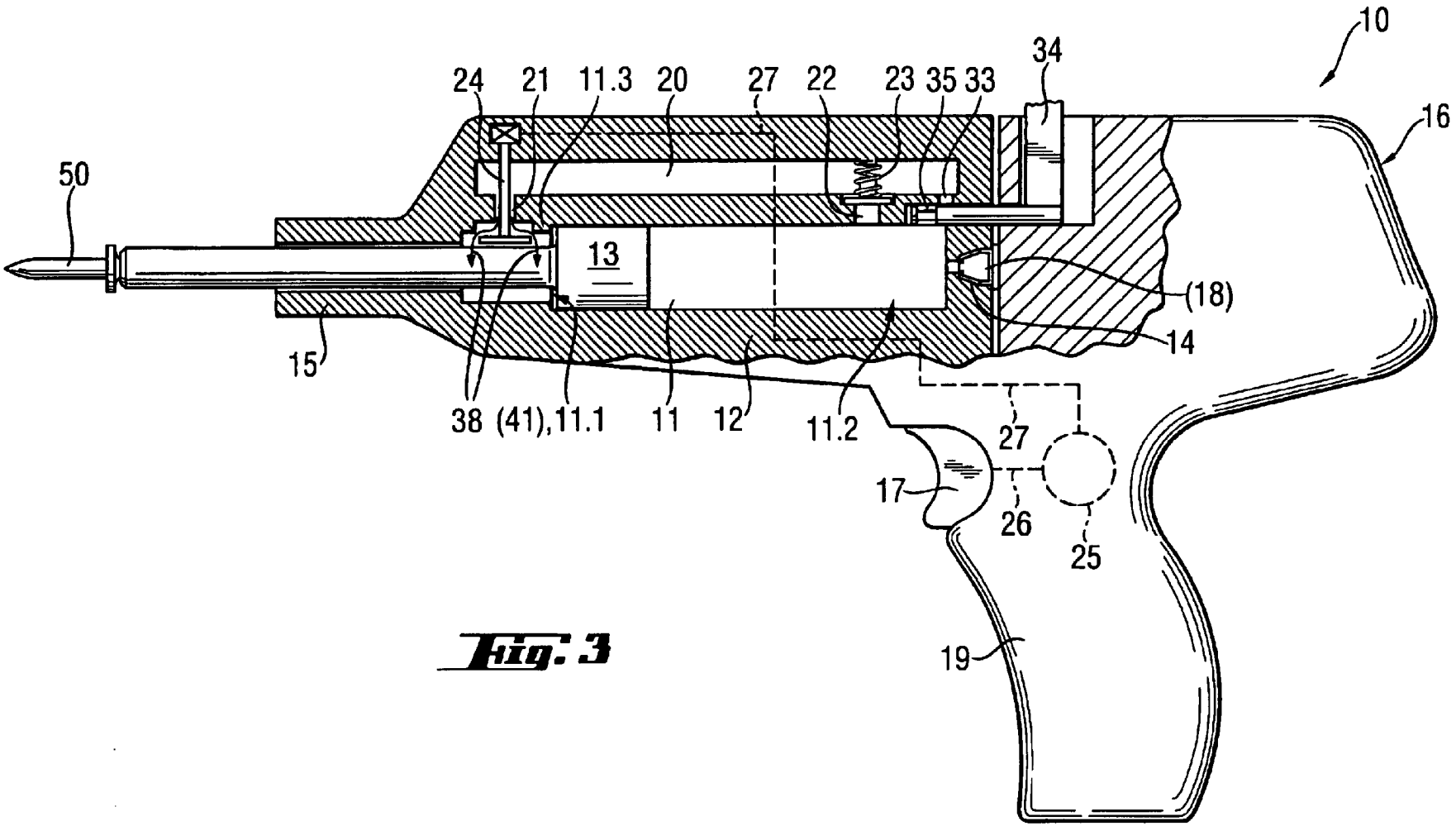
FIG. 3 a view similar to that of FIG. 1 but with the drive piston in its front end position.

FIG. 3 shows the drive piston 13 in its end position 41 in the front region 11.1 of the guide space 11 where the drive piston 13 engages a stop 11.3. A possible rebound of the drive piston 13 has already ended. From the time switch 25, a time-delayed signal is transmitted through the conductor 27 to the electronically controlled valve 24. The valve 24 opens, and the propellant gases 18' can now flow from the storage space 20 through the outlet channel 21 in the front region 11.1 of the guide space 11 for displacing the drive piston 13 back to its initial position 40 (FIG. 1).

Figure 7:
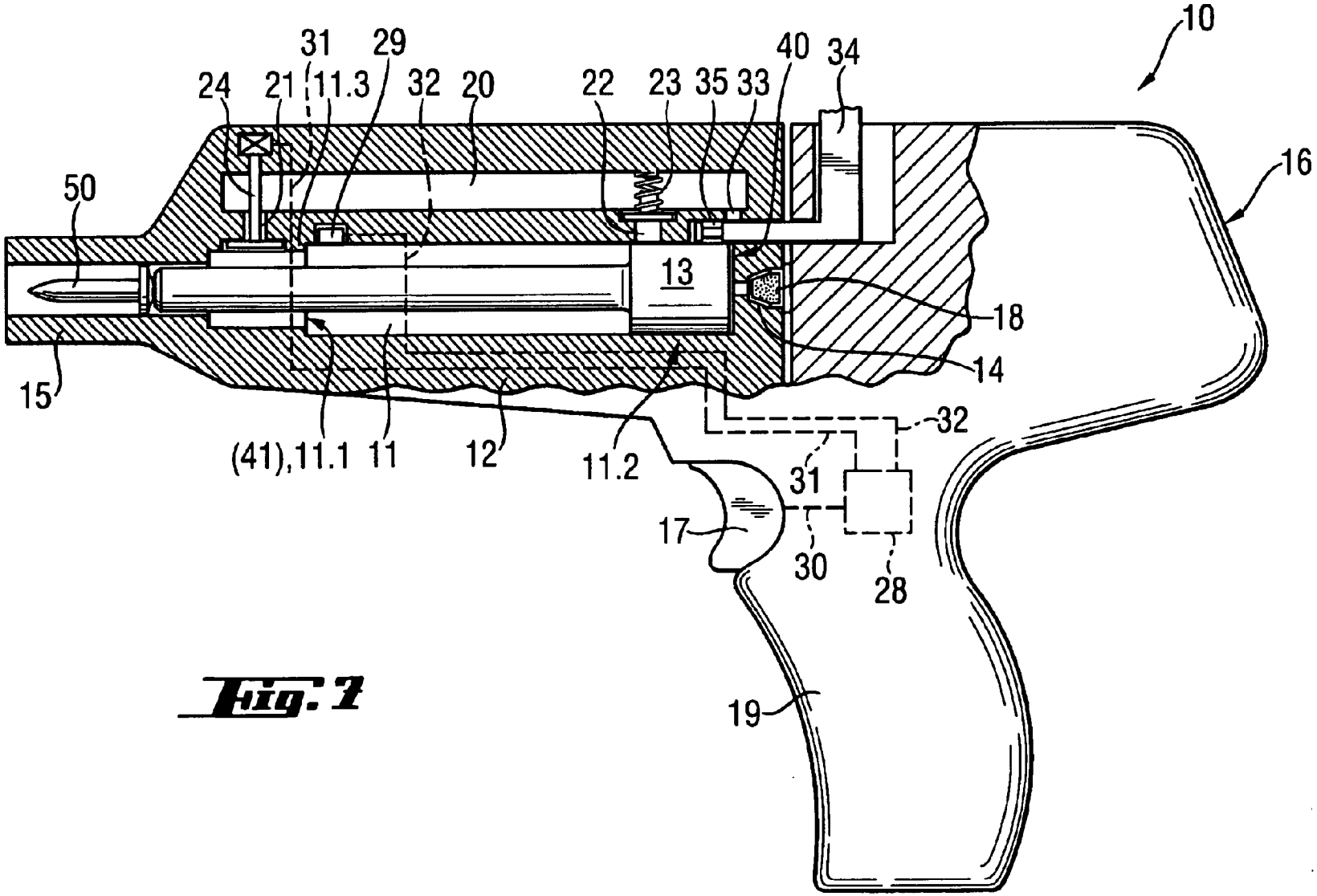
FIG. 7 a side, partially cross-sectional view of a further embodiment of a setting tool according to the present invention with the drive piston in its rear initial position.

FIG. 7, as it has already been mentioned above, shows a second embodiment of a setting tool according to the present invention. The setting tool 10, which is shown in FIG. 7, differs from that shown in FIGS. 1–6 in that the time-delayed signal for opening of the electronically controlled valve 24 is generated by a control unit 28 that cooperates with a sensor 29. The control unit 28 is connected with the actuation switch 17 by an electrical conductor 30, is connected with the sensor 29 by an electrical conductor 31, and is connected with the valve 24 by an electrical conductor 31. The sensor 29 is a position of the drive piston 13. The sensor 29 generates a position signal when the setting piston 13 occupies its end position 41 in the front region 11.1 of the guide space 11 (FIG. 3) after completion of the setting process.

For other particularities of the setting tool 10 shown in FIG. 7, reference should be made to the description referred to FIGS. 1–6.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A setting tool for driving fastening elements in a constructional component, comprising:

a piston guide (12) defining a guide space (11) having a front region (11.1) and a rear region (11,2);

a drive piston (13) displaceable in the guide space (11) by propellant gases generated by a propellant charge from an initial position (40) thereof in the rear region (11.2) of the guide space (11) to an end position (41) in the front region (11.) of the guide space;

a storage space (20) for the propellant gases;

a first valve (23) for connecting the storage space (20) with the rear region (11.2) of the guide space (11); and a second, electronically controlled valve (24) arranged at an outlet (21) of the storage space (20) for a time-delayed connection of the storage space (20) with the front region (11.) of the guide space (11).

2. A setting tool according to claim 1, comprising means for communicating to the electronically controlled valve (24) an opening signal time-delayed with respect to a signal for actuating an ignition process of the propellant charge.

3. A setting tool according to claim 2, wherein the communicating means comprises control means (28) for generating the time-delayed opening signal.

4. A setting tool according to claim 2, further comprising an actuation switch (17) for actuating the ignition process, and wherein the communicating means comprises an electronic time switch connected with the actuation switch (17) and the electronically controlled valve (24) for generating the time-delayed opening signal in response to the actuation of the actuation switch (17).

5. A setting tool according to claim 1, further comprising a passage (33) connected with the storage space (20) for controlling power of the setting tool.

6. A setting tool according to claim 1, further comprising sensor means (29) arranged in the piston guide (12) for determining at least one of drive piston position and drive piston speed, and means for communicating to the electronically controlled valve (24) time-delayed opening signal in response to a signal generated by the sensor means (29).

7. A setting tool according to claim 6, wherein the communicating means comprises control means (28) connected with the sensor means (29) and the electronically controlled valve (24) for generating the time-delayed opening signal in response to the signal generated by the sensor means (29) and for communicating the time-delayed opening signal to the electronically controlled valve.

8. A setting tool according to claim 1, further comprising an exhaust channel (39) surrounding, at least partially, the storage space (20).

* * * * *